US005232212A

United States Patent [19]

Weber

[11] Patent Number: 5,232,212

[45] Date of Patent: Aug. 3, 1993

[54] SHEET SENSOR IN SHEET FILM TRANSPORT APPARATUS

[75] Inventor: Günter Weber, Ostfildern, Fed. Rep. of Germany

[73] Assignee: Eastman Kodak Company, Rochester, N.Y.

[21] Appl. No.: 803,873

[22] Filed: Dec. 9, 1991

[30] Foreign Application Priority Data

Apr. 29, 1991 [DE] Fed. Rep. of Germany ..... 9105269

[51] Int. Cl.[5] ..... B65H 5/10

[52] U.S. Cl. ..... 271/11; 271/258; 250/561

[58] Field of Search ..... 271/258, 259, 261, 227, 271/11, 110, 111; 226/20, 21; 250/571, 548, 557, 561, 223 R

[56] References Cited

U.S. PATENT DOCUMENTS

| | | | |
|---|---|---|---|
| 3,335,662 | 8/1967 | Ritzerfeld | 271/258 X |
| 3,684,890 | 8/1972 | Hayne | 271/261 X |
| 4,314,159 | 2/1982 | Davis | 250/561 |

FOREIGN PATENT DOCUMENTS

| | | |
|---|---|---|
| 2258946 | 12/1972 | Fed. Rep. of Germany . |
| 2850351 | 11/1978 | Fed. Rep. of Germany . |
| 3716904 | 12/1988 | Fed. Rep. of Germany . |

*Primary Examiner*—Richard A. Schacher
*Attorney, Agent, or Firm*—Peter J. Bilinski

[57] ABSTRACT

Reflective type radiation sensor mounted on one side of the path of sheet film moving from one apparatus to another apparatus cooperates with a reflector mounted on the opposite side of the film path, preferably on a shaft of roller transport for moving the film sheet, to detect film sheet position, the radiation travel being other than at right angles to the film path.

4 Claims, 1 Drawing Sheet

SHEET SENSOR IN SHEET FILM TRANSPORT APPARATUS

TECHNICAL FIELD

This invention relates to an improvement in sheet sensors in sheet film transport apparatus such as that used in transporting x-ray sheet film from a first apparatus such as a cassette unloading apparatus, to a second apparatus such as film processing apparatus. A radiation sensor such as a photoelectric device detects the position of a film sheet passing from the first apparatus to the second apparatus.

BACKGROUND ART

U.S. patent application Ser. No. 07/427,135, filed Oct. 16, 1989 and allowed Aug. 20, 1991, discloses apparatus in which a film sheet is unloaded from a cassette by suction means and fed to a driven pair of transport rollers. An optoelectronic interrupter switch arranged in the transport path of the sheet and upstream of the transport rollers senses a sheet film. This activates control means which terminates the vacuum from the suction means so that the sheet when fed into the nip of the rollers is no longer held by the vacuum means. Such a switch requires considerable space for installation of the oppositely arranged transmitter and receiver components, each of which must have electrical connections.

SUMMARY OF THE INVENTION

According to the present invention, the sensor is of the reflective type, being located on one side of the film path, and a reflector is located on the opposite side of the film path. A novel feature of a preferred embodiment is the positioning of the sensor and reflector such that the emitted and reflected radiation travels other than at right angles to the path of film travel so as to avoid erroneous signals caused by radiation reflection from a film sheet surface. This enables a very simple and space saving installation.

In providing structure of this type, it is particularly helpful to mount a reflector carrying part (retaining means) on a rotatable shaft of a pair of transport rollers, with the reflector located below the film path and the reflective switch located above the film path and aimed across the film path at the reflector. The retaining means is conveniently provided with at least one stationary stop means. In a preferred embodiment the retaining means is of sheet metal and the reflector is on a bent-off portion thereof.

The preferred embodiment provides a particularly space saving arrangement in a section of the transport means that normally does not appear suitable for exact positioning of a reflector.

BRIEF DESCRIPTION OF THE DRAWINGS

The foregoing and other features and advantages will become apparent from the following description, taken in conjunction with the appended drawing, in which.

In a schematic representation.

DESCRIPTION OF THE PREFERRED FORM OF THE INVENTION

Figures 1, 2:
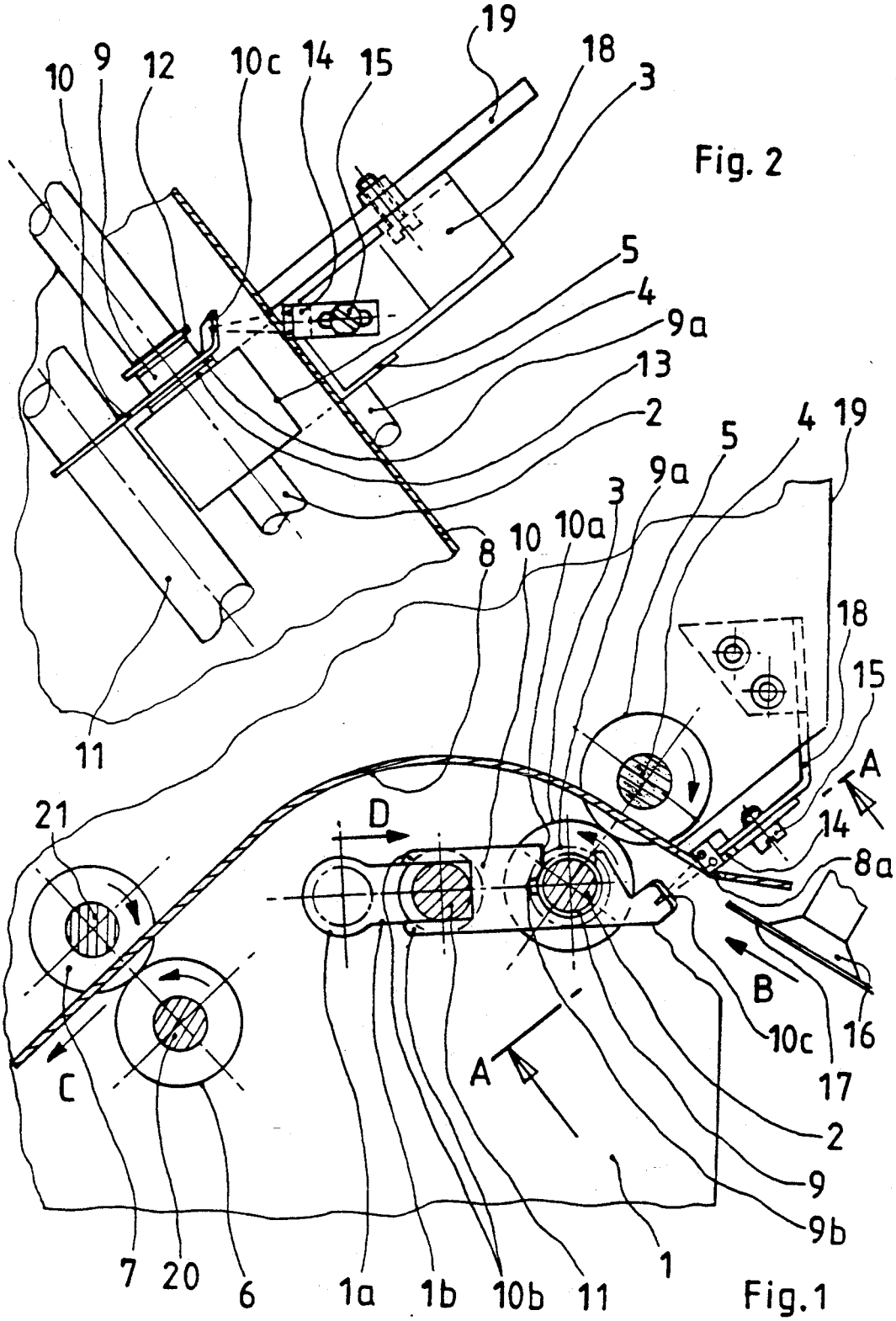
FIG. 1 shows a lateral view of the apparatus in cross section.
FIG. 2 shows the apparatus according to FIG. 1 as seen in the direction of arrows A—A.

The apparatus according to the invention is part of an apparatus (not shown) for automatically loading and unloading x-ray sheet film cassettes, as shown, for example, in said U.S. patent application Ser. No. 07/427,135, referred to above. In that apparatus, sheet film is removed from a cassette by suction means after the cassette is opened, and is fed to a transport device which advances the film to a processor.

In the following, the arrangement of a reflective switch 10*c*, 14 will be described which is arranged in the transport path of an apparatus of the above-described type to control the transition from a first transport device (suction means 16) to a second transport device (rollers 3,5).

FIG. 1 shows suction means 16 of a sheet film removal device (not shown) of a known type featuring a plurality of suction means 16 combined to form an array. In a known way, the suction means are moved into an opened cassette and lowered. The exposed film 17 in the cassette is picked up by applying a vacuum. The suction means 16 are then pivoted to an inclined position shown in FIG. 1 whereby the leading edge of the sheet film is bent up and separated from its support surface in a known manner. Bending up of the film edge to said inclined position also rigidizes the leading edge of the sheet film 17 in a transverse direction so that even particularly wide films are stabilized in the areas between suction means 16, preventing the film from sagging uncontrollably in those areas. The sheet film 17 engaged by suction means 16 is moved in the direction of arrow "B" into the nip of transport rollers 3,5.

Transport rollers 3,5 are part of a transport device feeding the sheet film along a guide plate 8 to further transport rollers 6,7 which feed the sheet film 17 in the direction of arrow "C" to a processor (not shown) of a known type.

Transport rollers 3,5 and 6,7 are mounted on rotatable shafts 2,4 and 20,21, respectively, which are supported by the machine frame 1, shafts 2 and 20 being driven, and the oppositely arranged shafts, 4 and 21 being spring-biased in a known manner (not shown) such that rollers 5 and 8 resiliently contact rollers 3 and 6, respectively. The parts of the machine frame 1 are fastened to each other by means of threaded spacers 11, one of which is shown in the drawing. A function of spacers 11 will be discussed below.

A housing wall 19 carries a support member 18 to which a reflective switch is fastened by screw 15. In the area of switch 14, which is arranged above the transport path of sheet film 17, guide plate 8 has an opening 8*a* for the sensor beam to pass through. The beam from switch 14 is aimed at a mirror which is arranged below the transport path of sheet film 17 and which is integral with retaining means 10. Retaining means 10 is of sheet metal and is arranged on a bushing 9 mounted on shaft 2. Retaining means 10 has a notch which positively receives a projection 9*b* on bushing 9.

A sleeve (not shown) fits about bushing 9 between retaining means 10 and a locking washer 13. The sleeve is annular and of resilient plastic material. It has a radial opening so that it can be spread open and pressed onto bushing 9, leaving the projection 9*b* of bushing 9 positioned in the radial opening of the sleeve. Bushing 9 also abuts another locking washer 12. The two locking washers 12 and 13 engage grooves in shaft 2.

At its left end, as seen in FIG. 1, retaining means 10 is bifurcated, forming two spaced projections 10*b* which the threaded spacer 11 engages to secure retaining means 10, and thereby mirror 10*c*, in place. The threaded portions of spacer 11 are at its ends and engage the machine frame as will now be explained.

The machine frame has key hole shaped openings or recesses 1*a*,1*b*. The ends of spacer 11 are inserted into these recesses, starting in the widening 1*a*, and spacer 11 is then moved to the right in FIG. 1, as indicated by arrow "D", into the slot formed by projection 10*b* of retaining means 10. Once in this position, spacer 11 is turned to thread its ends into the narrower portion 1*b* of the key hole type recesses in the machine frame, causing spacer 11 and retaining means 10 to be fixed in place.

Retaining means 10 has a bent of end portion 10*c* which has a reflective surface facing toward switch 14. The reflective surface may be in the form of an attached reflector or merely a highly polished surface on retaining means 10. The reflecting surface 10*c* is arranged at an angle of about 30 degrees relative to the transport plane or path of sheet film 17, and the reflective switch is directed toward the reflecting surface. Adjustments can be made by means of screw 15.

The arrangement of the reflective switch and surface 10*c* is such that the light travels at an inclined direction (other than at right angles) relative to the transport plane or path of sheet film 17. This is particularly advantageous because the film passing the reflective switch then cannot act as a mirror surface and produce erroneous signals by reflecting light back to the reflective switch. The light is usually infra red and is emitted intermittently by switch 14 by means of an appropriate control circuit in order to avoid exposure marks on the film.

OPERATION

As soon as the leading edge of a sheet film 17 moving in the direction of arrow "E" by suction means 16 interrupts the sensor beam of reflective switch 14, control means of a known type (not shown) is activated. After a predetermined time, this switches off the vacuum of suction means 16 and ventilates them, causing release of the film sheet. The release time is selected such that the suction means are ineffective when sheet film 17 engages transport rollers 3,5. Upon such release the suction means are lifted from sheet 17 by means, not shown, in order to prevent the suction means from sliding along the surface of the sheet film being advanced by rollers 3,5.

The sheet film engaged by rollers 3,5 is fed along the curved guide plate 8 to the pair of transport rollers 6,7 and from there in the direction of arrow "C" to a processor.

It will be understood that the invention is susceptible of variations from the preferred embodiment disclosed without departing from the spirit and scope of the invention. For example, retaining means 10 may be of molded plastic material having a mirror surface, and the retaining means may be provided with an integral bushing.

I claim:

1. In apparatus for advancing a film sheet along a path from a first apparatus to a second apparatus, in which a single radiation sensor detects the position of a film sheet passing from said first apparatus to said second apparatus, said sensor being of the reflective type which has both an emitter and a receiver, and being located on one side of the film path, and reflector means located on the other side of the film path and positioned to reflect emitted radiation to said receiver in the absence of a film sheet between said sensor and said reflector means, the improvement comprising:

suction means to move the film sheet from the first apparatus to said roller means of the second apparatus, said suction means being adapted to become inoperative in response to said sensor detecting a film sheet moving towards said roller means, said sensor and said reflector means being positioned such that with respect to the transport plane of the sheet films, the emitted and reflected radiation travel at other than right angles to the film sheet path so as to avoid reflection of the emitted radiation from the film sheet surface back to the receiver, said reflector means being arranged in an inclined position oriented towards said emitter and said receiver of said sensor.

2. In apparatus for advancing a film sheet along a path from a first apparatus to a second apparatus by roller means mounted on a rotating shaft, in which a single radiation sensor detects the position of a film sheet passing from said first apparatus to said roller means, said sensor being of the reflective type which has both a sensor and a receiver, and being located on one side of the film path, reflector means located on the other side of the film path and positioned to reflect emitted radiation to said receiver in the absence of a film sheet between said sensor and said reflector means, the improvement comprising:

means mounting said reflector means on said rotating shaft, suction means to move the sheet film from the first apparatus to roller means of the second apparatus, said suction means being adapted to become in operative in response to said sensor detecting a film sheet moving towards said roller means, said sensor and said reflector means being positioned such that with respect to the transport plane of the sheet films, the emitted and reflected radiation travel at other than right angles to the film sheet path so as to avoid reflection of the emitted radiation from the film sheet surface back to the receiver, said reflector means being arranged in an inclined position oriented towards said emitter and said receiver of said sensor.

3. The improvement set forth in claim 2, further comprising:

said reflector means being mounted on a member having an opening which receives said shaft, and bushing and retainer means on said shaft holding said member stationary while allowing said shaft to rotate freely.

4. The improvement set forth in claim 2, further comprising:

said member having a bifurcated portion forming an opening on a portion remote from said reflector means, and a fixed element engaging said opening to position said member.

* * * * *